US006591434B1

(12) United States Patent
De Cleene et al.

(10) Patent No.: US 6,591,434 B1
(45) Date of Patent: Jul. 15, 2003

(54) SOUND DAMPENED SINK

(75) Inventors: Christopher M. De Cleene, Searcy, AR (US); Mark A. Romo, Plymouth, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/067,170

(22) Filed: Feb. 4, 2002

(51) Int. Cl.[7] ..... A47K 1/04

(52) U.S. Cl. ..... 4/619; 4/638; 241/100.5; 241/46.013; 241/46.014; 181/284; 181/290

(58) Field of Search ..... 4/619, 638, 639, 4/654; 241/100.5, 46.018, 46.014, 46.013, 46.015; 181/290, 284

(56) References Cited

U.S. PATENT DOCUMENTS

| | | | | | |
|---|---|---|---|---|---|
| 2,581,920 | A | | 1/1952 | Kuhn | |
| 2,909,333 | A | | 10/1959 | Shewmon et al. | |
| 2,925,225 | A | | 2/1960 | Jordan | |
| 2,939,639 | A | | 6/1960 | Coss | |
| 2,949,246 | A | | 8/1960 | Hyde | |
| 2,991,018 | A | | 7/1961 | Jenkins | |
| 3,181,802 | A | | 5/1965 | Lung et al. | |
| 3,399,103 | A | | 8/1968 | Salyer et al. | |
| 3,399,104 | A | | 8/1968 | Ball, III et al. | |
| 3,472,305 | A | | 10/1969 | Lefes | |
| 3,817,356 | A | * | 6/1974 | Dahlquist | 188/268 |
| 4,075,288 | A | | 2/1978 | Graveron et al. | |
| 4,195,713 | A | | 4/1980 | Hagbjer et al. | |
| 4,693,772 | A | | 9/1987 | Douglas | |
| 4,693,775 | A | | 9/1987 | Harrison et al. | |
| 4,707,397 | A | | 11/1987 | Morimura et al. | |
| 4,724,243 | A | | 2/1988 | Harrison | |
| 4,749,434 | A | | 6/1988 | Harrison | |
| 4,769,166 | A | | 9/1988 | Harrison | |
| 4,819,503 | A | | 4/1989 | Fazi, Jr. et al. | |
| 4,921,753 | A | | 5/1990 | Harrison | |
| 4,978,474 | A | | 12/1990 | Johnston | |
| 5,016,297 | A | * | 5/1991 | Sauter et al. | 4/619 |
| 5,017,653 | A | | 5/1991 | Johnston | |
| 5,063,098 | A | * | 11/1991 | Niwa et al. | 428/76 |
| 5,135,594 | A | | 8/1992 | Johnston | |
| 5,188,513 | A | | 2/1993 | Byrnes | |
| 5,232,785 | A | | 8/1993 | Kita | |
| 5,240,645 | A | | 8/1993 | Strecker | |
| 5,279,900 | A | | 1/1994 | Takeuchi | |
| 5,924,635 | A | | 7/1999 | Koshimizu et al. | |
| 5,965,851 | A | * | 10/1999 | Herreman et al. | 181/200 |
| 6,093,358 | A | | 7/2000 | Schiewe et al. | |
| 6,173,458 | B1 | * | 1/2001 | Maddux | 4/626 |
| 6,420,447 | B1 | * | 7/2002 | Kittel et al. | 521/174 |
| 2002/0134615 | A1 | * | 9/2002 | Herreman et al. | 181/290 |

OTHER PUBLICATIONS

A page from a Dec. 3, 2001 web site of AcoustiSeal entitled "Vibration Dampers", admitted prior art, depicting segmented use of vibration dampers.

A material description sheet dated Aug. 31, 2000 from AcoustiSeal, entitled "AcoustiSeal 1432", admitted prior art, describing the dampening material used in the present invention.

* cited by examiner

*Primary Examiner*—Gregory L. Huson
*Assistant Examiner*—Azy Kokabi
(74) *Attorney, Agent, or Firm*—Quarles & Brady LLP

(57) ABSTRACT

A sink, and a method of reducing vibration and resulting noise of such sinks, are disclosed. The sink includes a basin, a drain and first and second pads. The basin has a bottom wall, side walls, and inner and outer surfaces of such walls. The drain is in the bottom of the basin, and first and second regions are defined between the drain orifice and the first and second sides, respectively. The pads are attached to the bottom and a side wall, in each case proximate respective midpoints of open regions thereon. The pads are a laminate of a rubber-like material and metal.

14 Claims, 2 Drawing Sheets

SOUND DAMPENED SINK

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to sinks as commonly employed in bathrooms and kitchens. It appears to be especially well suited for use with kitchen sinks made of sheet metal.

Sinks employed in bathrooms, kitchens and other environments can be made from a variety of materials such as sheet metal, cast iron or plastics. Such sinks can be efficient vibration and thus sound transmitters. This is a particularly significant problem when a garbage disposal is connected to the sink, and may also be a problem to some extent when silverware, pots or other items are accidentally dropped into a sink basin.

Vibration transmitted along a counter top can also cause objects on the counter to move, and thus possibly fall off the counter top. Further, noise transmitted by such sinks may be annoying not only to those who are near the sink, but also to those who may be disturbed in other rooms or adjacent apartments.

A number of techniques have been employed to reduce such vibration and noise. In one approach the entire (or most of the) outer surface of the sink is coated with a layer of foam, rubberized, or asphaultic material. Because it is the outer, rather than the inner, surface of the sink that is coated, the attachment of the material does not adversely affect the appearance of the sink from the vantage point of one who is using the sink. However, this can increase the weight of the sink (and thus shipping costs), and in any event uses extra material. Further, while coating the entire bottom surface of the sink in this manner does reduce the amount of vibration somewhat, the coated sink is still capable of vibrating to some extent since the coating only increases the mass of the sink by a relatively small amount.

U.S. Pat. No. 2,991,018 describes a modified technique where a large, thick and heavy metal plate is clamped directly under the basin around the drain outlet. It covers what appears to be the majority of the underside of the basin. The plate must be clamped to the sink by way of adjustable screws near the sleeve/drain. Small rubber pads are positioned between the sink and the outer corners of the plate to insure firm contact between the plate and the sink such that the sink and the plate are effectively one piece.

Although clamping of such a large metal plate to the underside of the sink reduces much of the noise created by the sink, particularly during operation of a garbage disposal, it also has certain disadvantages. It uses a substantial amount of material, greatly increases the weight of the sink, and has assembly cost.

In unrelated developments, AcoustiSeal, Inc. has developed a line of thin laminate sound dampening materials which they primarily market for use in the automotive field, and which may have been previously applied to sound dampen certain appliances. The materials comprise a laminate made of an aluminum foil constraining layer and a viscoelastic polymer layer bonded together with the viscoelastic layer being itself a sticky material so that the laminate can be "taped" against a surface to be sound dampened. However, Applicants are unaware of any suggestion in the art to apply this material to sinks, much less teachings of how the material can be used in connection with kitchen sinks for optimal advantage.

Thus, it can be seen that a need still exists for improved techniques to sound/vibration dampen sinks.

SUMMARY OF THE INVENTION

In one aspect the invention provides a sink having a basin having a bottom wall and side walls, each of said walls having an inner surface and an outer surface. A drain orifice extends through the first basin's bottom wall. A first vibration dampening pad is adhered to the outer surface of the basin's bottom wall between the orifice and a side wall, and a second vibration dampening pad is adhered to the outer surface of a basin side wall. Both of the pads can be a laminate of a metal (e.g. aluminum) foil layer and a butyl polymer layer.

In other preferred forms there are two such pads adhered to the outer surface of the bottom wall positioned on opposed sides of the drain orifice, and the pad adhered to the side wall is centrally located on that side wall. In such form, the butyl polymer layer is considerably thicker than (e.g., at least twice as thick as) the metal foil layer, and the sticky butyl polymer layer adheres the butyl polymer layer to the basin.

In particularly desirable forms, the surface area of the first pad is less than half the surface area of the outside surface of the bottom wall, and the surface area of the second pad is less than half the surface area of the outer surface of the side wall to which it is adhered.

In most applications, each basin of the sink will have four such side walls, each of which has such an outside surface, and each of which has a vibration dampening pad adhered thereto. The pads adhered to the four such side walls will adhere adjacent a central portion of each such side wall, with the pads being essentially rectangular and positioned essentially parallel to an edge of the walls to which they are adhered. Typically, each pad will have an outer surface area of less than one-hundred square centimeters, yet be positioned so as to damp vibration along the sink.

In another aspect the invention provides a sink including a basin having a bottom wall and side walls, each of said walls having an inner surface and an outer surface. A drain orifice extends through the basin's bottom wall. A first vibration dampening pad adheres to the outer surface of the first basin's bottom wall between the orifice and a first of the side walls, and a second, separate vibration dampening pad adheres to the outer surface of the first basin's bottom wall between the orifice and a second of the side walls. The second of the side walls opposes the first of the side walls. Each of the first and second vibration dampening pads includes a primary layer formed from a butyl-type material and a secondary layer formed from a metallic material.

In another aspect the invention provides a method of dampening vibration along a sink having a basin with a bottom wall and four side walls. Each such wall has an outer surface and an inner surface. One adheres to the outer surface of each of the walls a vibration dampening patch comprising a laminate of a metal foil and a polymer. The surface area of each patch is less than half of the surface area of the outer surface of the wall to which the patch is adhered. Two such patches are positioned on the bottom wall, on opposed sides of the drain orifice.

The present invention thus provides a technique for sound dampening a sink without greatly increasing the weight of the sink, or using unnecessary amounts of expensive sound deadening materials. The sound dampening patches can be applied without tools or special processes by merely "taping" them to the outside of the basin.

Centrally (e.g. some portion of the patch being within three centimeters of the geographic center of the wall to which it is adhered) positioning the patches make them more effective even though they bond to only a small part of the sink wall. Further, sandwiching the drain by opposed patches effectively deadens the garbage disposal vibration, without requiring a full ring around the garbage disposal.

These and other advantages of the invention will be apparent from the detailed description and drawings.

DETAILED DESCRIPTION OF THE PREFERRED EMBODIMENT

Figure 1:
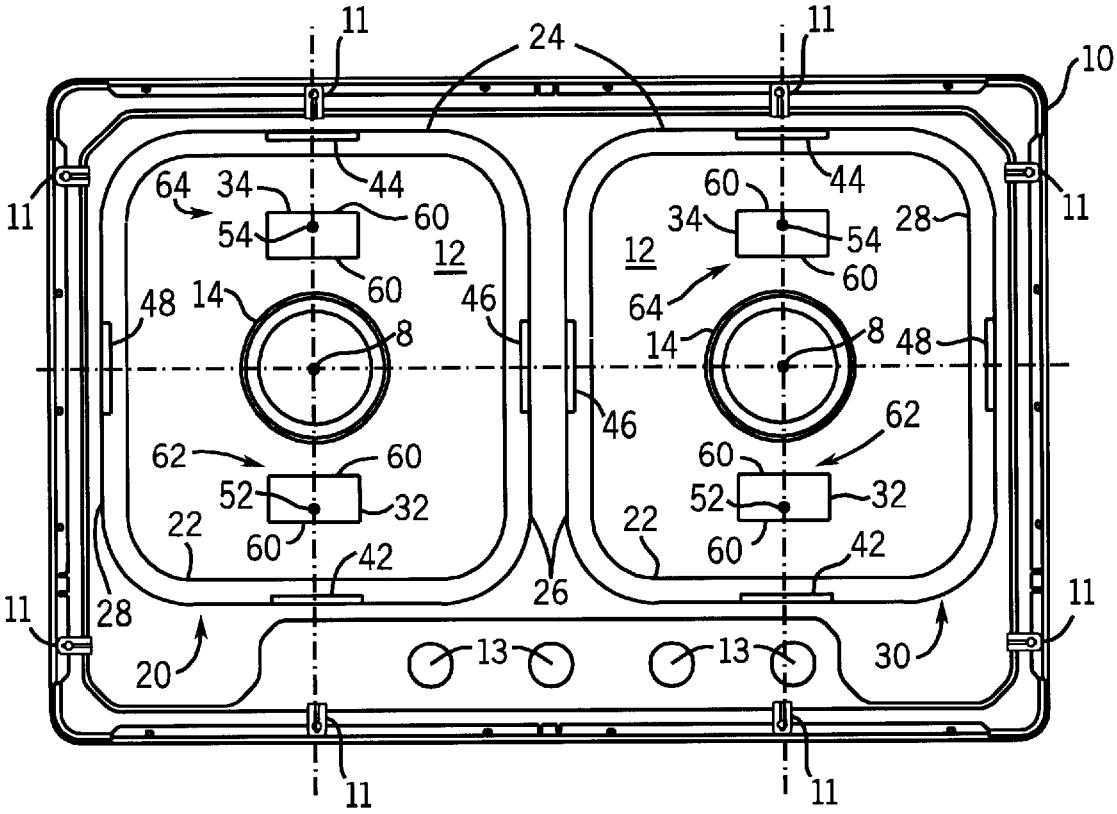
FIG. 1 is a bottom plan view of a double basin stainless steel kitchen sink of the present invention.

Referring to FIG. 1, sink 10 has first and second basins 20 and 30, respectively, although the present invention is also applicable to sinks having only a single basin or more than two basins. As is conventional for two basin sinks, the dimensions of the rim are approximately 84 centimeters by 56 centimeters, and the basins 20, 30 are each approximately 35½ centimeters by 38 centimeters by 20 centimeters deep.

The dimensions of each basin can vary depending upon the type of sink, and it is not necessary that each basin be rectangular, or even have four side walls. For example, rounded basins are known.

The basins 20, 30 each have a bottom wall 12, side walls 22, 24, 26 and 28, and the usual drain orifice 14. Each such wall has an outer/lower surface 16 and an inner/upper surface 18. The inner surfaces contact the water, while the outer surfaces 16 typically are hidden from view under a counter top or the like (not shown). The drain orifices 14 can be coupled to drainage piping, but it is more typical for one orifice to be linked to a garbage disposal (not shown). In the preferred embodiment the kitchen sink is made from steel. Also, in the embodiment shown, the sink includes multiple clasps 11 for attaching the sink to a countertop and holes 13 for faucets and faucet controls. Alternate embodiments need not include the clasps 11 or holes 13, or can have different arrangements of such components.

To reduce the amount of vibration (and thus noise) transmitted and/or amplified by the sink 10, at least first and second pads 32 and 48 are adhered to a bottom wall and one side wall respectively. Also, in this embodiment there is an extra pad 34 on an opposed side of the orifice, and pads 42, 44, 46 and 48 respectively, are attached to the side walls of the basins.

The pads on the side walls are at least partially centrally located. The pads 32 and 34 are attached at or near first and second midpoints 52 and 54 of regions 62 and 64, respectively, along each basin bottom 12. The first and second regions 62 and 64 are between the drain orifices 14 and the sides 22 and 24, respectively.

The positioning of the pads adjacent the central portion of the open surfaces has been discovered to be important because vibration has been experimentally determined (e.g., using a laser vibrometer) to be greatest at those portions. Thus, even though the remainder of the wall is not adhered to, significant reduction effects occur. Moreover, because the front to back distance of the basin bottom wall is greater than the side to side distance, positioning the pads closer to the front and rear walls (as distinguished from the side walls) is more effective.

With respect to pads 42, 44, 46 and 48 attached to the side walls, they are also positioned at or near respective centers 38 of these sides. For example, the bottom edges of these pads are shown as positioned near the side wall centers. This particular positioning has been experimentally determined to maximize the reduction in the amount of vibration due to curved edges connecting the bottoms 12 and sides, and due to the slight sloping of the sides inward as one proceeds from the tops 36 to the bottoms 12.

Figure 4:
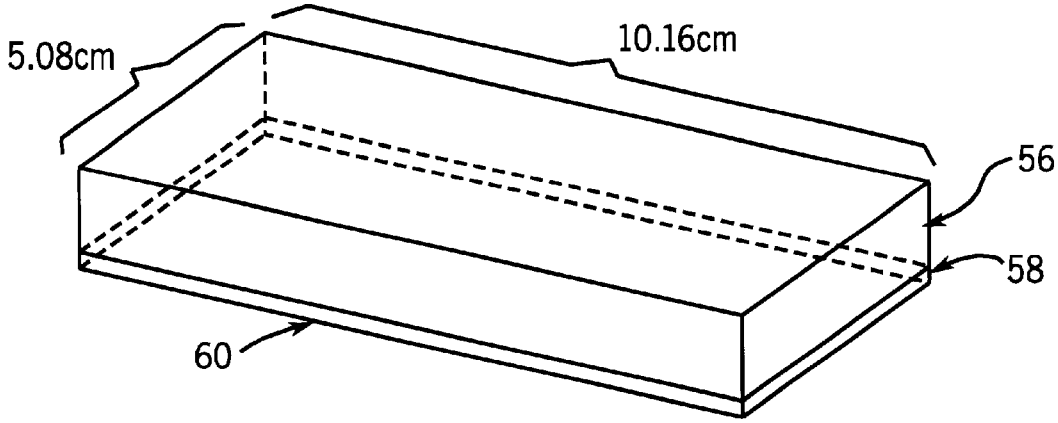
FIG. 4 is an enlarged schematic view of a vibration dampening pad useful in connection with the present invention.

With particular reference to FIG. 4, each of the pads is a two-layer pad having a primary butyl polymer/rubberized layer 56 and a secondary metal foil layer 58. The preferred pad laminate is available from AcoustiSeal, Inc. of Troy, Mich. as the Acoustiseal 1432 laminate.

The preferred metal is aluminum foil of about 0.070 millimeter in thickness. The preferred primary layer 56 is composed of a rubberized material such as a butyl polymer layer of approximately 0.152 millimeter in thickness. In the preferred embodiment, the butyl polymer layer is a pressure-sensitive adhesive that is sufficiently sticky to adhere both to the aluminum foil and to the sink 10.

The metal sink and the metal foil act as constraining layers damping vibration in the butyl polymer layer. That is, vibration of the sink 10 causes shearing deformation of the butyl polymer layer 56 to occur. This shearing deformation in turn causes the vibrational energy of the sink 10 to be transformed into thermal energy. Consequently, much of the vibrational energy of the sink 10 is dissipated in a manner other than by the production of noise or transmission of vibration.

In alternate embodiments, the primary layer 56 can be another type of rubberized, plasticized or viscoelastic type material, such as an acrylic layer. Also, in some alternate embodiments, the primary layer 56 itself would not itself be sticky, but instead the primary layer would adhere to the secondary layer 58 and the sink 10 by way of one or more additional adhesives. Such additional adhesives could, for example, be additional layers of butyl-type of acrylic materials.

While conventional systems reduce the vibration and noise of a sink by significantly increasing the overall mass of the sink, the present embodiment of sink and pads operates to reduce the vibration and noise primarily by converting vibrational energy into thermal energy. The amount of pad material is kept to a minimum by selective positioning.

The preferred pads are rectangular with a width of 5.08 centimeters and a length of 10.16 centimeters. The overall area of each pad is consequently less than one hundred square centimeters, and in any event less than half of the overall surface area of the corresponding wall. The pads 32 and 34 attached to the bottoms 12 are positioned so that the longer, 10.16-centimeter edges 60 of each of the pads are parallel to the first and second sides 22, 24. Similarly, the pads 42, 44, 46 and 48 are positioned so that the longer, 10.16-centimeter edges 60 of each of the pads are parallel to the edges of the bottom wall 12.

Figure 2:
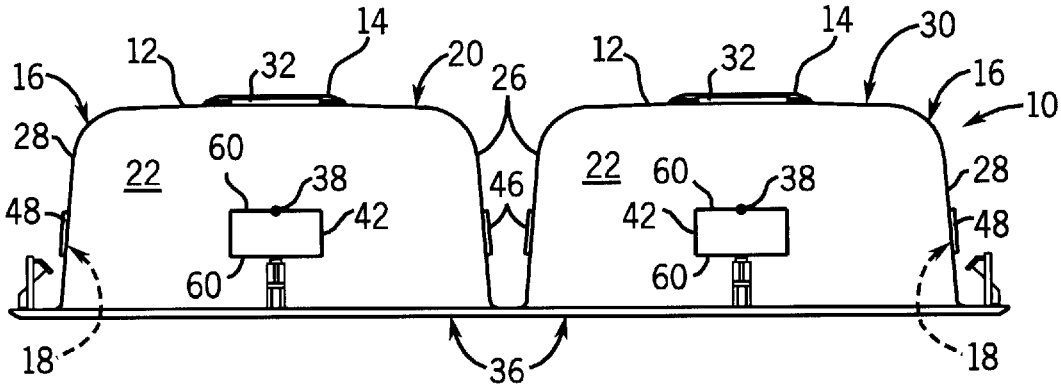
FIG. 2 is a rear elevational view thereof when the sink is inverted, the front elevational inverted view being identical thereto.
Figure 3:
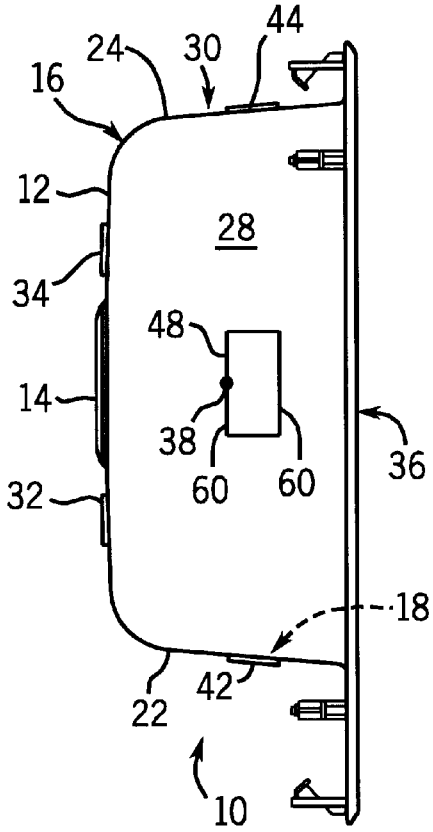
FIG. 3 is a left side elevational view thereof when the sink is inverted, the right side inverted elevational view thereof being identical thereto.

These sizes, shapes, number and arrangements of pads on the sink 10 have been experimentally determined to provide significant reduction in the overall vibration and noise production of the sink 10, with relatively small amounts of pad being used to minimize the costs of the pads. However, in alternate embodiments a different arrangement or number of pads, and/or pads having different sizes or shapes from those of FIGS. 1 and 2, could be employed.

For example, some of the pads (e.g., the pads on the side walls) or even all of the pads could be square 5.08 centimeter by 5.08 centimeter pads. In another alternate embodiment, only three pads could be used, one on each side of the drain orifice, and one on a side wall. In this case, the pads could be circular. In another embodiment, only two rectangular pads would be used, on either side of the drain orifice.

To produce the sink 10, one forms the sink structure apart from the pads in a conventional manner. The pad material is then purchased in bulk from a supplier, and cut into an appropriate shape. Any peel-off protective layer is removed from the adhesive, and the pads are then press adhered to the sink outer walls.

While the foregoing specification illustrates and describes the preferred embodiments of this invention, it is to be understood that the invention is not limited to the precise construction herein disclosed. The invention can be embodied in other forms without departing from the spirit or essential attributes of the invention. Accordingly, reference should be made to the following claims, rather than to the foregoing specification, as indicating the scope of the invention.

Therefore, the invention should not be limited to just the described embodiment. To ascertain the full scope of the invention, the following claims should be referenced.

INDUSTRIAL APPLICABILITY

The invention provides sinks, such as kitchen sinks, provided with improved vibration dampening, and methods for forming such sinks.

We claim:

1. A sink, comprising:

a basin having a bottom wall and side walls, each of said walls having an inner surface and an outer surface;

a drain orifice through the basin's bottom wall;

a first vibration dampening pad adhered to the outer surface of the first basin's bottom wall between the orifice and a side wall; and a second, separate vibration dampening pad adhered to the outer surface of a basin side wall;

wherein the surface area of the first pad is less than half the surface area of the outside surface of the bottom wall; and wherein the surface area of the second pad is less than half the surface area of the outer surface of the side wall to which it is adhered.

2. The sink of claim 1, wherein there are two such pads adhered to the outer surface of the bottom wall, positioned on opposed sides of the drain orifice.

3. The sink of claim 1, wherein both of the pads are a laminate comprising a metal foil layer and a butyl polymer layer.

4. The sink of claim 3, wherein the metal foil is aluminum foil.

5. The sink of claim 3, wherein the pad adhered to the side wall is centrally located on the side wall.

6. The sink of claim 3, wherein the butyl polymer layer is at least twice as thick as the metal foil layer.

7. The sink of claim 1, wherein the basin comprises four such side walls, each of which having such an outside surface, and each of which having a vibration dampening pad adhered thereto.

8. The sink of claim 7, wherein the pads adhered to the four such side walls are adhered adjacent a central portion of each such side wall.

9. The sink of claim 1, wherein at least one of the pads is essentially rectangular and positioned essentially parallel to an edge of a wall to which it is adhered.

10. The sink of claim 1, wherein each pad has an outer surface area of less than one-hundred square centimeters.

11. The sink of claim 1, wherein the pads are positioned so as to damp vibration along the sink.

12. A sink, comprising:

a basin having a bottom wall and side walls, each of said walls having an inner surface and an outer surface;

a drain orifice through the basin's bottom wall;

a first vibration dampening pad adhered to the outer surface of the first basin's bottom wall between the orifice and a first of the side walls; and a second, separate vibration dampening pad adhered to the outer surface of the first basin's bottom wall between the orifice and a second of the side walls, wherein the second of the side walls opposes the first of the side walls;

wherein each of the first and second vibration dampening pads includes a primary layer formed from a butyl-type material and a secondary layer formed from a metallic material; and wherein each of the surface areas of said first and second pads comprise less than half the surface area of the outer surface of the bottom wall to which they are adhered.

13. The sink of claim 12, further comprising a plurality of additional pads along the side walls of the basin.

14. A method of dampening vibration along a sink having a basin with a bottom wall and four side walls, each such wall having an outer surface and an inner surface, the method comprising:

adhering to the outer surface of each of the walls a vibration dampening patch comprising a laminate of a metal foil and a polymer;

wherein the surface area of each said patch comprises less than half of the surface area of the outer surface of the wall to which the patch is adhered.

* * * * *